US011280501B2

(12) United States Patent
Kim et al.

(10) Patent No.: US 11,280,501 B2
(45) Date of Patent: Mar. 22, 2022

(54) VENTILATION APPARATUS

(71) Applicant: LG Electronics Inc., Seoul (KR)

(72) Inventors: Wontae Kim, Seoul (KR); Sangcheol Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 188 days.

(21) Appl. No.: 16/466,329

(22) PCT Filed: Dec. 4, 2017

(86) PCT No.: PCT/KR2017/014053

§ 371 (c)(1),
(2) Date: Jun. 4, 2019

(87) PCT Pub. No.: WO2018/105966

PCT Pub. Date: Jun. 14, 2018

(65) Prior Publication Data

US 2019/0309958 A1 Oct. 10, 2019

(30) Foreign Application Priority Data

Dec. 6, 2016 (KR) ..... 10-2016-0164787

(51) Int. Cl.
*F24C 15/20* (2006.01)
*F24F 7/007* (2006.01)
(Continued)

(52) U.S. Cl.
CPC ..... *F24C 15/2071* (2013.01); *F24C 15/20* (2013.01); *F24F 7/007* (2013.01);
(Continued)

(58) Field of Classification Search
CPC ..... F24C 15/2071; F24C 15/20; F24F 7/007; F24F 13/10; F24F 13/20; F24F 2013/205; F24F 2221/46; A47J 36/38; B08B 15/00
See application file for complete search history.

(56) References Cited

U.S. PATENT DOCUMENTS 6,336,451 B1 * 1/2002 Rohl-Hager ..... B08B 15/02 126/299 D
2011/0240004 A1 * 10/2011 Corleoni ..... F24C 15/20 126/299 R (Continued)

FOREIGN PATENT DOCUMENTS

JP 2007-247921 9/2007
JP 2008196801 A * 8/2008

(Continued)

OTHER PUBLICATIONS

Extended European Search Report in European Appln. No. 17879025.9, dated Jul. 10, 2020, 8 pages.

(Continued)

*Primary Examiner* — Jorge A Pereiro
(74) *Attorney, Agent, or Firm* — Fish & Richardson P.C.

(57) ABSTRACT

The present disclosure relates to a ventilation apparatus. The ventilation apparatus of the present disclosure comprises: a casing; a suction device accommodated in the casing and having a suction fan for generating a suction force for sucking in air; and a vortex forming device accommodated in the casing and having a swirler rotating below the casing to form a vortex and a driving motor for rotating the swirler, wherein the swirler includes a rotating plate having an air passage hole and a plurality of blades arranged and spaced apart in a circumferential direction along the rim of the rotating plate, and the vortex forming device is positioned lower than the rotation center of the suction fan in the casing.

15 Claims, 7 Drawing Sheets

(51) Int. Cl.
*F24F 13/10* (2006.01)
*F24F 13/20* (2006.01)

(52) U.S. Cl.
CPC ..... *F24F 13/10* (2013.01); *F24F 13/20* (2013.01); *F24F 2013/205* (2013.01); *F24F 2221/46* (2013.01)

(56) References Cited

U.S. PATENT DOCUMENTS

| | | | | |
|---|---|---|---|---|
| 2012/0037144 | A1* | 2/2012 | Corleoni | F24C 15/20 126/299 R |
| 2015/0059731 | A1* | 3/2015 | Rho | F24C 15/20 126/299 D |
| 2016/0150601 | A1* | 5/2016 | Kim | H05B 6/6423 219/757 |
| 2016/0161133 | A1* | 6/2016 | Oh | F24F 13/06 415/62 |
| 2016/0273779 | A1* | 9/2016 | Kim | F24C 15/2092 |
| 2019/0331344 | A1* | 10/2019 | Zecevic | F24C 15/2042 |
| 2019/0338959 | A1* | 11/2019 | Zecevic | F24C 15/2042 |

FOREIGN PATENT DOCUMENTS

| | | | |
|---|---|---|---|
| KR | 10-2000-0051144 | A | 8/2000 |
| KR | 10-2006-0018147 | | 2/2006 |
| KR | 10-0854449 | | 8/2008 |
| KR | 10-2008-0094412 | | 10/2008 |
| KR | 10-2011-0105739 | A | 9/2011 |
| KR | 10-2012-0086642 | A | 8/2012 |
| KR | 10-2016-0060969 | A | 5/2016 |
| KR | 10-2016-0069500 | A | 6/2016 |
| KR | 10-2016-0112350 | | 9/2016 |
| WO | WO2011021760 | | 2/2011 |
| WO | WO2012102462 | | 8/2012 |
| WO | WO2014007535 | | 1/2014 |
| WO | 2015/034273 | | 3/2015 |
| WO | WO2016117921 | | 7/2016 |

OTHER PUBLICATIONS

International Search Report in International Application No. PCT/KR2017/014053, dated Mar. 14, 2018, 4 pages.

* cited by examiner

VENTILATION APPARATUS

CROSS-REFERENCE TO RELATED APPLICATIONS

This application is a National Stage application under 35 U.S.C. § 371 of International Application No. PCT/KR2017/014053, filed on Dec. 4, 2017, which claims the benefit of Korean Patent Application No. 10-2016-0164787, filed on Dec. 6, 2016. The disclosures of the prior applications are incorporated by reference in their entirety.

TECHNICAL FIELD

The present disclosure relates to a ventilation apparatus.

BACKGROUND ART

The ventilation apparatus is used in factories, homes and restaurants where contaminants are generated in large amounts. Particularly, the ventilation apparatus may be usefully used when a partial pollution source is generated on the floor surface away from an exhaust port, when the exhaust port is difficult to be provided near a pollution source by another installation, or when a pollution source instantly occurs.

Korean Unexamined Patent Publication No. 2008-0094412 (published on Oct. 23, 2008), which is a prior art, discloses a vortex-type local ventilation apparatus.

The local ventilation apparatus suctions contaminants while allowing contaminants to flow using a rotating plate rotated by a driving unit and a swirler including a plurality of blades provided at the rim of the rotating plate.

The location ventilation apparatus disclosed in the prior art may be located above a cooking appliance in a kitchen and may be exhausted after the contaminated air is suctioned in the course of using the cooking appliance. In this case, the local ventilation apparatus may be installed on the wall of the kitchen or adjacent to the wall.

The local ventilation apparatus suctions contaminants while allowing contaminants to flow using a rotating plate rotated by a driving unit and a swirler including a plurality of blades arranged at the rim of the rotating plate.

In the prior art, although the contaminated air may be suctioned using vortex, it may be difficult to form the vortex depending on the installation positions of the ventilation apparatus and thus suction performance may be deteriorated. In other words, when there is a wall or an obstacle on one side of the swirler, it is difficult to form a vortex due to the wall or the obstacle, so suction performance may be deteriorated.

In addition, the driving unit is located inside an exhaust pipe and the swirler is provided on the rotation shaft of the driving unit, so the installation position of the ventilation apparatus may be restricted. Accordingly, when there are heating units at front and rear portions of a cooling apparatus used in the kitchen like a cooking appliance, the contaminated air may not be effectively suctioned when a cooking material is heated by the heating units.

In addition, as the swirler, which is rotated at a higher speed, is exposed to the outside, the safety of a user may be not ensured.

DISCLOSURE

Technical Problem

The present disclosure provides a ventilation apparatus capable of improving the performance of suctioning contaminated air using a swirler forming vortex.

The present disclosure provides a ventilation apparatus in which contaminated air is prevented from being raised when the contaminated air is generated in the course that a cooling material is cooked by a cooking appliance positioned under the ventilation apparatus, thereby improving the performance of suctioning contaminated air.

The present disclosure provides a ventilation apparatus capable of facilitating the replacement or the repair of a vortex forming device.

The present disclosure provides a ventilation apparatus in compact size.

Technical Solution

According to one aspect of the present disclosure, a ventilation apparatus may include a casing, a suction device received in the casing and including a suction fan to generate suction force for suctioning air, and a vortex forming device received in the casing and including a swirler rotated at a lower portion of the casing to generate the vortex and a driving motor to rotate the swirler. The swirler may include a rotating plate having an air passage hole and a plurality of blades arranged along a rim of the rotating plate and spaced apart from each other in a circumferential direction. The vortex forming device may be positioned lower than a rotation center of the suction fan, in the casing.

According to the present embodiment, the casing may include a flow hole to introduce external air, and the swirler may be positioned closer to the flow hole than the suction fan.

The casing may include a flow hole to introduce external air, the suction fan may be disposed to overlap with the swirler in a vertical direction, and the swirler may be disposed to overlap with the flow hole in the vertical direction.

The casing may include a first casing in which the suction device is received, and a second casing disposed under the first casing, having a horizontal sectional area wider than a horizontal sectional area of the first casing, and receiving the vortex forming device therein.

The first casing may extend upward from a top surface of the second casing, a rear surface of the first casing and a rear surface of the second casing may form the same plane, the rear surfaces of the first casing and the second casing may face a wall, and a front surface of the second casing may be positioned in front of a front surface of the first casing.

An uppermost point of the driving motor may be positioned higher than a lowermost point of the suction device, based on a bottom surface of the second casing.

A rotation center of the swirler may be positioned in front of a vertical line passing through the rotation center of the suction fan, based on the wall.

The suction device further may include a fan housing to receive the suction fan, and the rotation center of the swirler may be positioned in front of the fan housing, based on the wall.

An extending line of a rotation center of the swirler may be positioned outside the first casing.

An extending line of a rotation center of the swirler may be interposed between the fan housing and the first casing.

A distance from a rotation center of the swirler to a front surface of the second casing may be shorter than a distance from a rotation center of the swirler to a rear surface of the second casing.

A flow hole may be formed in the second casing, and may have a diameter greater than a left-right width of the first casing.

The vortex forming device may further include a flow guide to guide air, which flows in a process that the swirler rotates, downward, and the driving motor may be positioned under a top surface of the second casing and positioned above the flow guide.

The suction device may further include a fan housing to receive the suction fan, and a portion of the fan housing may be received inside the second casing.

The fan housing may be positioned above a flow guide, and at least a portion of the driving motor may overlap with the fan housing in a horizontal direction.

Advantageous Effects

According to the present disclosure, since the vortex forming device forms vortex under the ventilation apparatus, the suction performance of the suction device may be improved in the process that the suction device suctions the air by suction force thereof.

In addition, the contaminated air is prevented from being away from the wall in the process of heating the cooking material by the cooking appliance positioned under the ventilation apparatus. Accordingly, the contaminated air may be prevented from being spread throughout a kitchen having the cooking appliance.

In addition, the air for forming the vortex may be prevented from flowing along the wall.

In addition, as the suction grill is disposed under the swirler, the safety of the user may be improved by preventing the user from accessing the swirler in the process of the rotation of the swirler.

In addition, since the uppermost point of the driving motor is positioned higher than the lowermost point of the suction device, based on a bottom surface of the second casing, the arrangement of the parts provided in the ventilation apparatus is optimized, so the ventilation apparatus in compact size may be implemented.

BEST MODE

Mode for Invention

Figure 1:
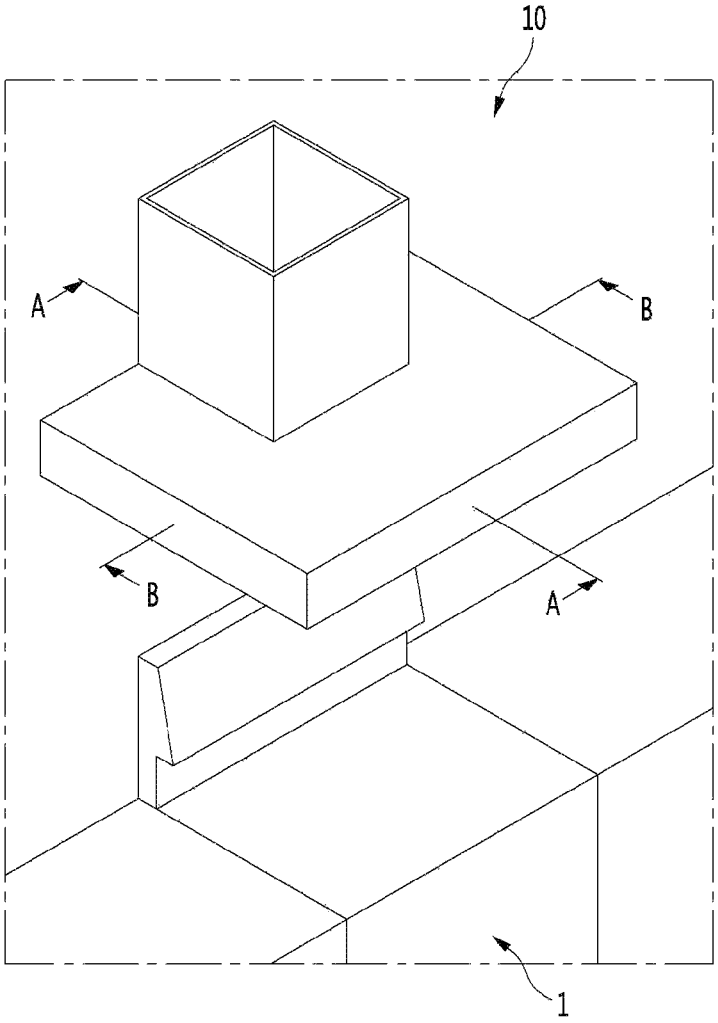
FIG. 1 is a view illustrating the state that a ventilation apparatus according to an embodiment of the present disclosure is installed in a kitchen.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a view illustrating the state that a ventilation apparatus according to an embodiment of the present disclosure is installed in a kitchen.

Referring to FIG. 1, a ventilation apparatus 10 according to an embodiment of the present disclosure may be installed in a space where contaminated air needs to be smoothly exhausted. For example, FIG. 1 illustrates that the ventilation apparatus 10 is installed in a kitchen.

The kitchen may be provided therein with a cooking appliance 1 for cooking food, and air around the cooking appliance 1 may be contaminated during the cooking of the food by the cooking appliance 1. The contaminated air rises above the cooking appliance 1 because the temperature of the air is higher than that of surrounding air.

When the contaminated air rises and stagnates in the kitchen in which the cooking appliance 1 is placed, there is a problem that the comfort of the kitchen is deteriorated, and smell contained in the contaminated air is absorbed into the kitchen, thereby requiring ventilation for a long time.

The ventilation apparatus 10 may be positioned above the cooking appliance 1 such that the contaminated air generated during cooking of the food by the cooking appliance 1 may be discharged to the outside of the kitchen.

Various cooking appliances 1 may be employed, but may be positioned adjacent to the wall of the kitchen. Therefore, to effectively exhaust contaminated air generated in the process of cooking food by the cooking appliance 1, the ventilation apparatus 10 is installed on the wall W of the kitchen or may be installed at a position adjacent to the wall W of the kitchen.

A storage compartment may be present on one side or opposite sides of the ventilation apparatus 10 depending on the structure of the kitchen.

In the present specification, a wall "W" of the kitchen or a wall of a storage compartment collectively be referred to "wall".

Figure 2:
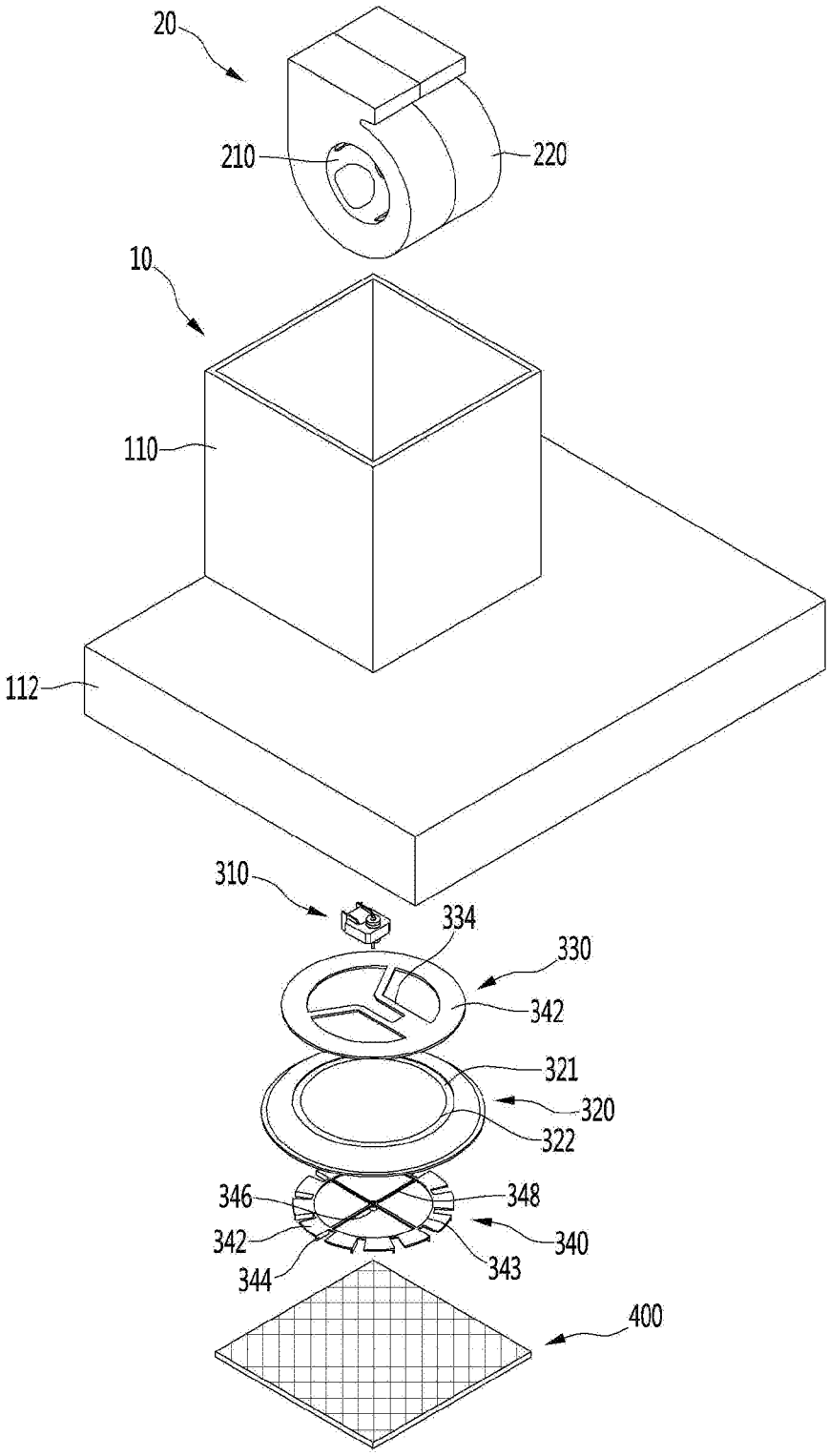
FIG. 2 is an exploded perspective view of a ventilation apparatus according to an embodiment of the present disclosure.
Figure 3:
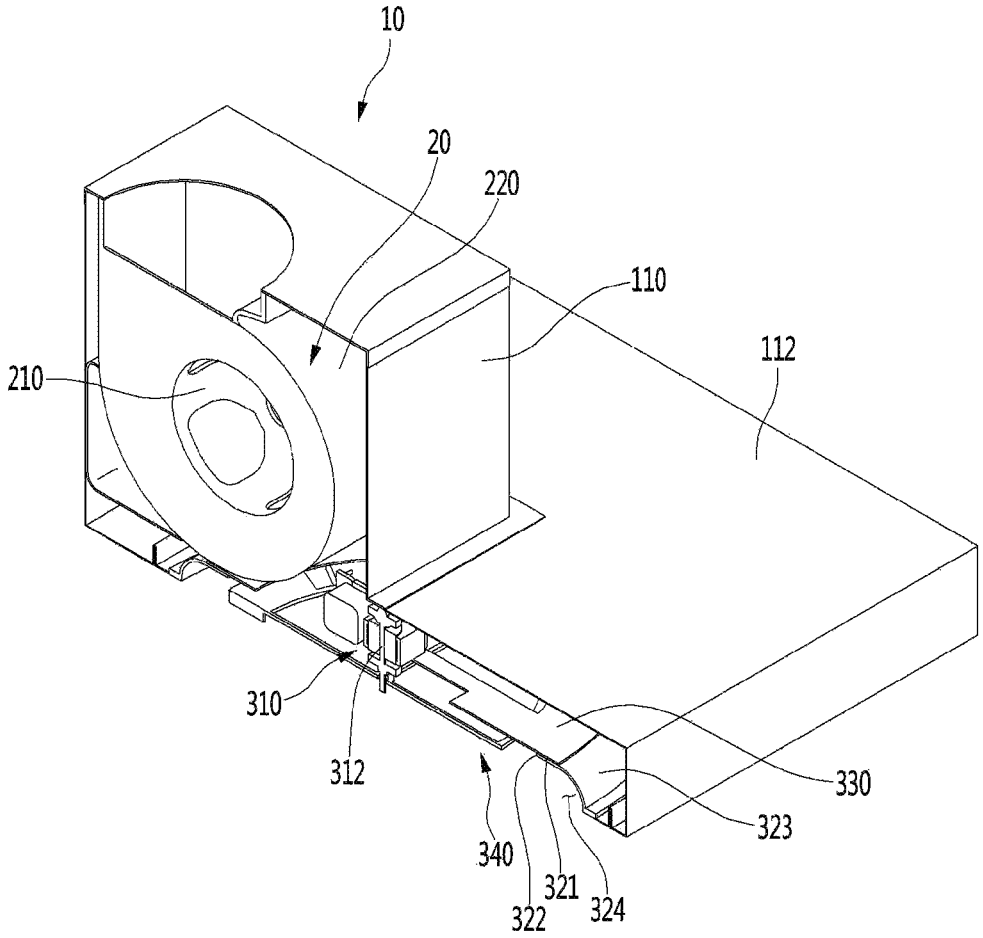
FIG. 3 is a perspective view taken along line A-A of FIG. 1.
Figure 4:
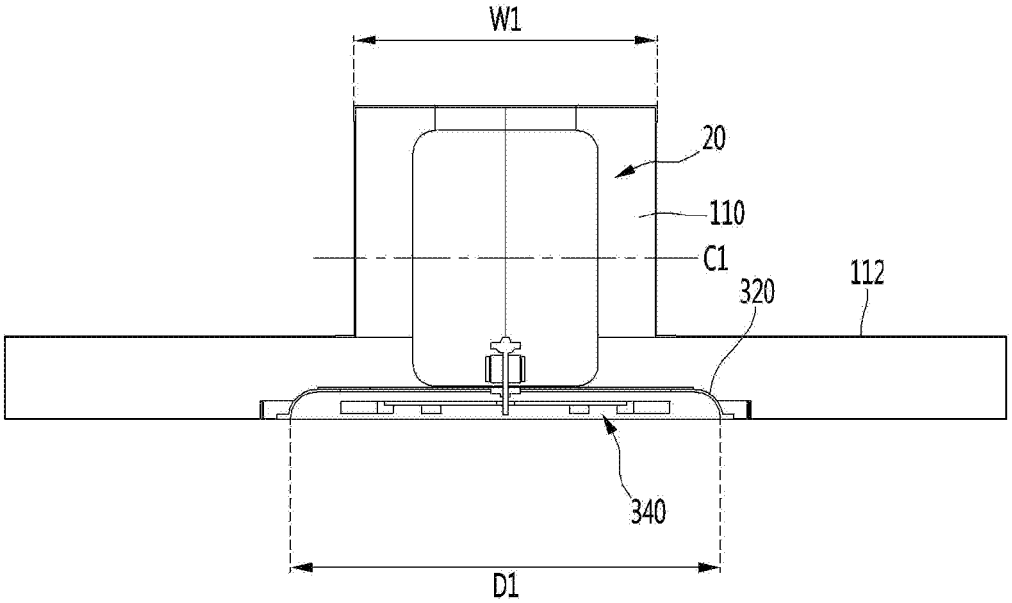
FIG. 4 is a sectional view taken along line B-B of FIG. 1.

FIG. 2 is an exploded perspective view of a ventilation apparatus according to an embodiment of the present disclosure, FIG. 3 is a perspective view taken along line A-A of FIG. 1, and FIG. 4 is a sectional view taken along line B-B of FIG. 1.

Figure 5:
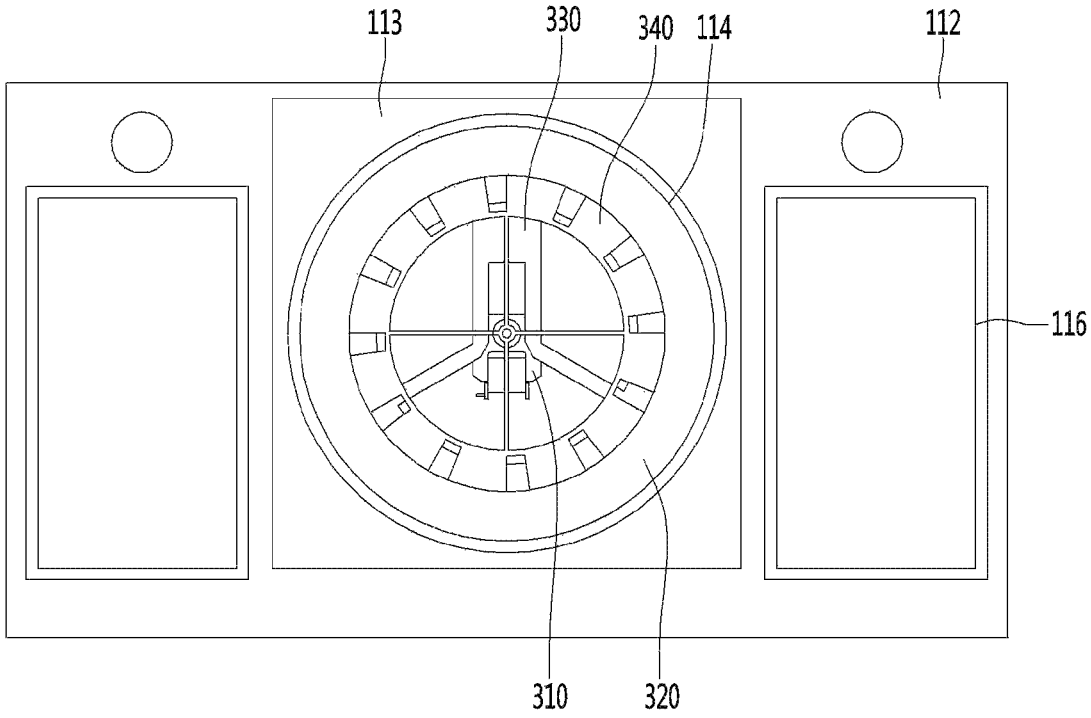
FIG. 5 is a bottom view of a ventilation apparatus according to an embodiment of the present disclosure.
Figure 6:
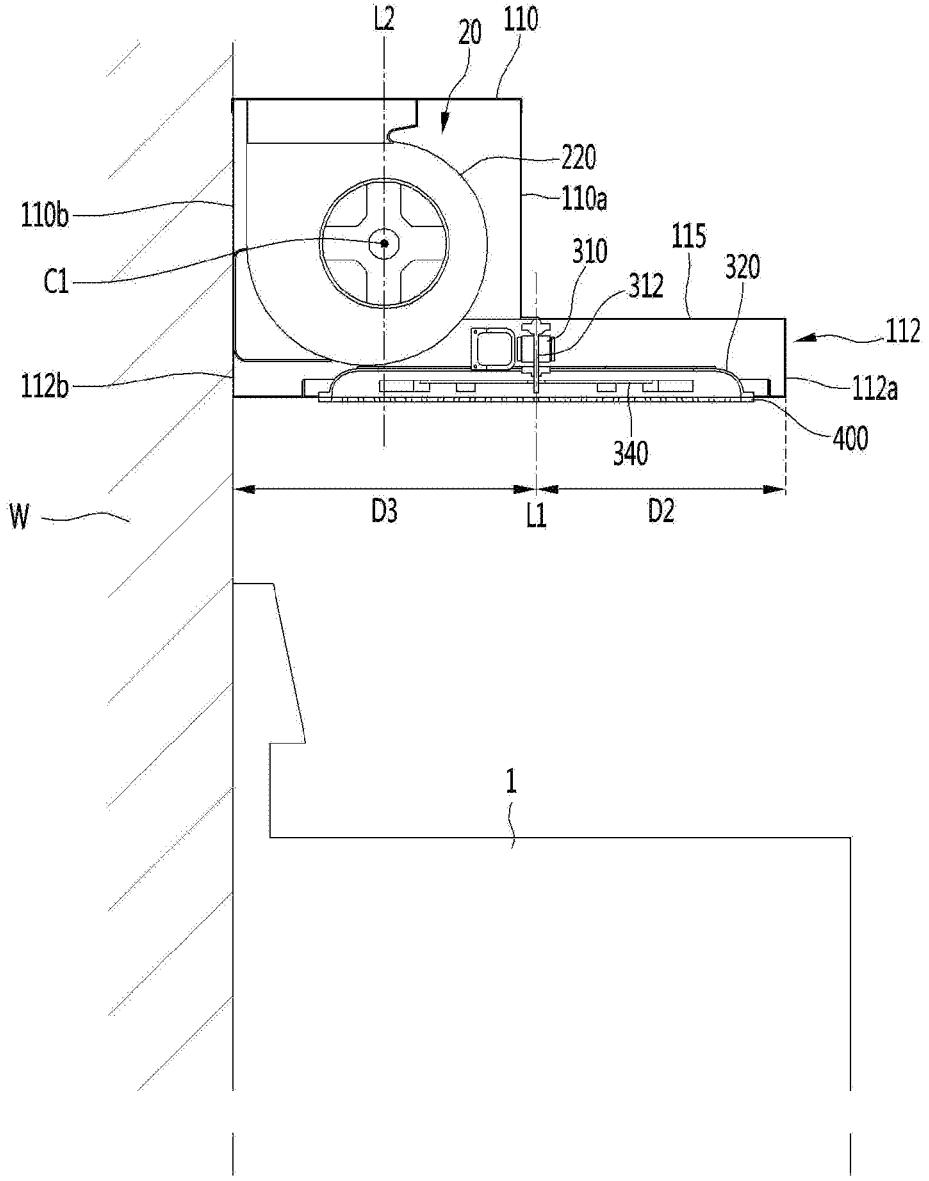
FIG. 6 is a sectional view illustrating the arrangement of a suction device and a vortex forming device according to an embodiment of the present disclosure.

FIG. 5 is a bottom view of a ventilation apparatus according to an embodiment of the present disclosure. FIG. 6 is a sectional view illustrating the arrangement of a suction device and a vortex forming device according to an embodiment of the present disclosure.

Referring to FIGS. 2 to 6, the ventilation apparatus 10 according to an embodiment of the present disclosure may include a casing that provides a flow passage for guiding the contaminated air, which is suctioned, to the outside.

In addition, the ventilation apparatus 10 may further include a suction device 20 to generate a suction force and a vortex forming device 30 to form a vortex.

The casing may include a first casing 110 in which the suction device 20 is received and a second casing 112 in which the vortex forming device 30 is received.

The first casing 110 extends upward from a top surface 115 of the second casing 112.

In this case, a horizontal sectional area of the second casing 112 may be formed to be wider than a horizontal sectional area of the first casing 110.

For example, when viewed based on FIG. 3, a front-rear length of the second casing 112 may be formed to be longer than a front-rear length of the first casing 110.

In addition, when viewed based on FIG. 4, the left-right width of the second casing 112 may be formed to be longer than a left-right width W1 of the first casing 110.

In addition, a rear surface 110*b* of the first casing 110 and a rear surface 110*a* of the second casing 112 form the same plane, and a front surface 112*a* of the second casing 112 is positioned in front of a front surface 110*a* of the first casing 110.

In the present disclosure, the rear surfaces 110*b* and 112*b* of the casings 110 and 112 face the wall and the front surfaces 110*a* and 112*a* of the casings 110 and 112 may be opposite surfaces to the rear surfaces 110*b* and 112*b*.

In addition, according to the present disclosure, the term "forward direction" refers to a direction to face a user from the wall when the user stands while facing the wall W.

The front face 112*a* of the second housing 112 is located closer to the user than the front face 110*a* of the first housing 110 when the user stands facing the wall W.

This means that when the front surface 112*a* of the second casing 112 is positioned farther away from the wall W than the front surface 110*a* of the first casing 110.

The suction device 20 may include a suction fan 210, a suction motor (not illustrated) to rotate the suction fan 210, and a fan housing 220 receiving the suction fan 210 to allow air flow when the suction fan 210 is rotated.

The present disclosure is not limited thereto, but suction fans 210 may be coupled to opposite sides of one suction motor.

A portion of the suction device 20 may be received in the first casing 110 and another portion of the suction device 20 may be received in the second casing 112 For example, a portion of the fan housing 220 may be received in the second casing 112.

In this case, the suction device 20 may be received in the first casing 110 in the state that the rotation center C1 of the suction fan 210 is horizontal.

Opposite sides of the fan housing 220 may be spaced apart from the left and right sides of the first casing 110, when viewed based on FIG. 3, in the state that the suction device 20 is received in the first casing 110.

Accordingly, the contaminated air may be introduced into the fan housing 220 from opposite sides of the fan housing 220 and then discharged to the upper portion of the fan housing 220.

Meanwhile, an entire portion of the vortex forming device 30 may be positioned in the second casing 112.

The vortex forming device 30 may include a driving motor 310, a swirler 340 receiving power from the driving motor 310 to rotate, and a flow guide 320 to guide flowing air downward in the process of rotating the swirler 340.

A flow hole 114 is formed in a bottom surface 113 of the second casing 112 and the swirler 340 may be positioned above the flow hole 114.

The driving motor 310 may be positioned below the top surface 115 of the second casing 112 and may be positioned above the flow guide 320.

As described above, according to the present disclosure, as the vortex forming device 30 is positioned in the second casing 112, when a suction grill 400 to be described later is separated from the second casing 112, a user may easily access the vortex forming device 30, so the vortex forming device 30 may be easily serviced or replaced.

Lighting units 116 may be positioned at opposite sides of the flow hole 114 in the second casing 112. The lighting units 116 may be turned on when the ventilation apparatus 10 is operated.

The swirler 340 may include a rotating plate 342 and a plurality of blades 344 arranged along the rim of the rotating plate 342 and spaced apart from each other in a circumferential direction.

An air passage hole 343 may be formed in the rotating plate 342 such that the air rising toward the vortex forming device 30 passes through the rotating plate 342. For example, the rotating plate 342 may be provided in the form of a ring.

Each of the plurality of blades 344 may extend downward from the bottom surface of the rotating plate 342 to push a portion of air in a radial direction of the rotating plate 342 before the air passes through the rotating plate 342.

In addition, for example, each of the plurality of blades 344 may be formed by cutting out a portion of the rotating plate 342 and bending the cut-out portion of the rotating plate 342 at a substantially 90 degrees. In addition, each of the plurality of blades 344 may be coupled to the rotating plate 342.

The flow guide 320 may form a space 324 for positioning the swirler 340. The flow guide 320 may have a recessed surface 321 recessed upward to form the space 324, when viewed based on FIG. 3. In addition, the flow guide 320 may include a through hole 322 through which air may pass. The through hole 322 may be provided in the recessed surface 321.

The swirler 340 may be positioned in the space 324 formed in the flow guide 320. In addition, the swirler 340 may be positioned under the through hole 322.

The flow guide 320 may include a guide surface 323, which is inclined downward, toward the outer portion of the flow guide 320 from the center of the flow guide 320 such that the vortex is formed under the flow guide 320 by the swirler 340. For example, the guide surface 323 may extend such that the recessed surface 321 is rounded toward the outer lower portion of the recessed surface 321.

When the swirler 340 rotates in one direction, the blade 344 of the swirler 340 radially pushes a portion of the contaminated air, which flows toward the air passage hole 343 of the rotating plate 342, outward from the rotating plate 342.

In this case, the air radially pushed has to flow away from the center of the swirler while flowing downward to form the vortex under the flow guide 320.

To allow the air pushed radially to flow downward, the outer portion of the guide surface 323 may be inclined downward to the outside.

As described above, since the flow guide 320 includes the guide surface 323, the flowing direction of the air pushed radially outward from the rotating plate 342 by the blade 344 of the swirler 340 may be changed to be a downward direction by the guide surface 323.

As the air pushed by the blade 344 of the swirler 340 flows along the guide surface 323 as described above, the air deviating from the guide surface 323 of the flow guide 320 may be inclined downward while flowing.

When the contaminated air passes through the flow hole 114 of the second casing 112, air around the flow hole 114 intends to flow into the flow hole 114 of the second casing 112, as well as the contaminated air passing through the flow hole 114. The vortex may be formed under the swirler 340 by the flow of air.

In other words, as the flow guide 320 guides downward the air flowing in the radial direction of the swirler 340, the vortex may be effectively formed under the swirler 340.

When a portion of the suction device 20 is disposed in the second casing 112, the distance between the suction device 20 and the flow hole 114 is reduced, so the flow loss of the air may be reduced. The suction performance (or the exhaust performance) may be improved.

When a portion of the suction device 20 is disposed in the second casing 112, at least a portion of the driving motor 310 may overlap with the fan housing 220 in the horizontal direction.

The highest point of the driving motor 310 may be positioned higher than the lowest point of the suction device 20 based on the bottom surface 113 of the second casing 112. Therefore, the arrangement of parts in the ventilation apparatus 10 is optimized, and thus the ventilation apparatus 10 may be realized in a compact size.

The flow guide 320 may be positioned at a lower portion of the fan housing 220 to prevent interference between the suction device 20 and the flow guide 320, when a portion of the suction device 20 is disposed in the second casing 112.

In other words, the height of the recessed surface 321 of the flow guide 320 may be lower than the minimum height of the fan housing 220 based on the bottom surface of the second casing 112.

The swirler 340 may further include a shaft coupling part 346 to be connected with a shaft 312 of the driving motor 310 and at least one connection rib 348 to connect the shaft coupling part 346 to the rotating plate 342.

The air passage hole 343 may be arranged to overlap with the through holes 322 of the flow guide 320 in the vertical direction such that the contaminated air smoothly flows. The shaft coupling part 346 may be positioned in the air passage hole 343 of the rotating plate 342.

Accordingly, the air flowing in a shaft direction of the swirler 340 may pass through the air passage hole 343 and the through hole 322 without direction change and the distance between the air passage hole 343 and the through hole 322 may be reduced.

The driving motor 310 may be installed in a mounting part 330 and the mounting part 330 may be, for example, fixed to the flow guide 320.

The mounting part 330 includes a fixed part 332 fixed to the flow guide 320 and formed in the shape of a circular ring and a support part 334 positioned in an area, in which the fixed part 332 is formed, to support the driving motor 310.

The shaft 312 of the driving motor 310 may pass through the through hole 322 of the flow guide 320 such that the shaft 312 of the driving motor 310 is coupled to the swirler 340.

The vortex forming device 30 may further include a suction grill 400 to filter the air suctioned through the flow hole 114.

The suction grill 400 may have the form of a square grill, for example, and may be coupled to the bottom surface 113 of the second casing 112. For example, the suction grill 400 may be coupled to the second casing 112 in a sliding manner.

According to the present disclosure, when the suction grill 400 is provided under the swirler 340, the user is prevented from accessing the swirler 340 in the process of rotating the swirler 340, so the safety of the user is improved.

Hereinafter, the arrangement of the suction device 20 and the vortex forming device 30 will be described in detail.

Referring to FIG. 4, the maximum diameter D1 of the flow guide 320 or the diameter of the flow hole 114 in the second casing 112 may be formed to be greater than the width W1 of the first casing 110.

Accordingly, when the suction device 20 is operated, an amount of air introduced along the flow hole 114 may be increased, and an amount of air dropping along the flow guide 320 by the vortex forming device 30 may be increased, so the vortex may be easily formed.

Referring to FIG. 6, the vortex forming device 30 may be positioned lower than the rotation center C1 of the suction fan 220.

The vortex forming device 30 may be positioned close to the flow hole 114 inside the second casing 112. Accordingly, the swirler 340 is positioned closer to the flow hole 114 than the suction fan 220. The swirler 340 has to be positioned close to the flow hole 114 to reduce the height of the vortex forming device 30 and to smoothly form the vortex.

A first extension line L1 of the shaft 312 of the driving motor 310 (or may be called the rotation center of the swirler 340) may be spaced apart from a second extension line L2, which is virtual and vertical to the rotation center C1 of the suction fan 220).

The first extension line L1 (or the rotation center of the swirler 340) may be positioned in front of the second extension line L2 based on the wall.

A third extension line to connect the first extension line L1 of the shaft 312 of the driving motor 310 (or may be called "rotation center of the swirler 340") with the second extension line L2, which is virtual and vertical to the rotation center C1 of the suction fan 220, and may be vertical to the wall W.

The rotation center of the swirler 340 extends in the vertical direction inside the second casing 112 and the rotation center C1 of the suction fan 220 may extend in the horizontal direction in the first casing 110.

The first extension line L1 of the shaft 312 of the driving motor 310 (or the rotation center C1 of the swirler 340) is positioned in front of the fan housing 220 with respect to the wall.

The present disclosure is not limited, but the first extension line L1 of the shaft 312 of the driving motor 310 may be positioned outside the first casing 110. For example, the first extension line L1 of the shaft 312 of the driving motor 310 may be positioned in front of the front surface 110*a* of the first casing 110 based on the wall.

As another example, the first extension line L1 of the shaft 312 of the driving motor 310 may be positioned between the suction fan 220 and the front surface 110*a* of the first casing 110.

A portion of the flow hole 114 of the second casing 112 overlaps with the fan housing 220 in a vertical direction, and another portion of the flow hole 114 of the second casing 112 does not overlap with the fan housing 220 in the vertical direction.

According to the above arrangement, a portion of the flow hole 114 of the second casing 112 overlaps with the fan housing 220 in the vertical direction and another portion of the flow hole 114 of the second casing 112 does not overlap with the fan housing 220 in the vertical direction.

At this time, the suction fan 220 overlaps with the swirler 340 in the vertical direction, and the swirler 340 overlaps with the flow hole 114. Accordingly, the flowing length may be prevented from being increased until the air introduced through the flow hole 114 flows to the suction fan 220.

Figure 7:
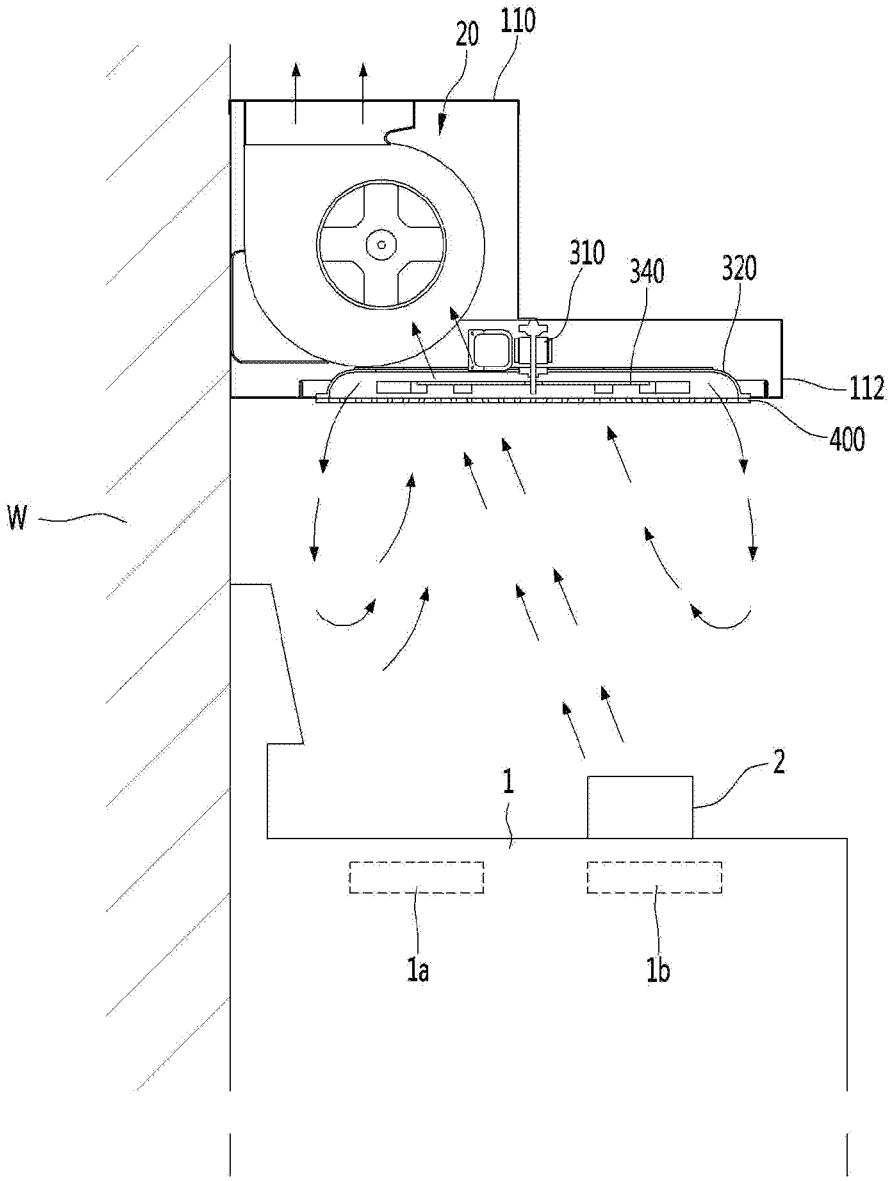
FIG. 7 is a view illustrating an air flow formed when the ventilation apparatus operates according to an embodiment of the present disclosure.

FIG. 7 is a sectional view illustrating the flow of air, which occurs when the ventilation apparatus operates, according to an embodiment of the present disclosure.

Referring to FIGS. 1 to 7, when an operation command of the ventilation apparatus 10 is input, the suction motor (not illustrated) and the driving motor 310 are turned on.

When the suction motor (not illustrated) is turned on, the suction fan 220 is rotated to generate a suction force for suctioning the contaminated air.

When the driving motor 310 is turned on, the swirler 340 is rotated so that the air forming the vortex may flow down the ventilation apparatus 10.

Specifically, when the swirler 340 rotates in one direction, the blade 344 of the swirler 340 pushes the contaminated air, which flows toward the air passage hole 343 of the rotating plate 342, radially outward from the rotating plate 342.

Since the flow guide 320 includes the guide surface 323, the flow direction of the air, which is pushed radially outward of the rotating plate 342 by the blade 344 of the swirler 340, is changed downward by the guide surface 323.

As the air pushed by the blade 344 as described above flows along the guide surface 323, the air, which is to form the vortex, deviates from the guide surface 323, is discharged through the flow hole 114, is inclined downward while flowing.

When the contaminated air passes through the flow hole 114 of the second casing 112, air around the flow hole 114 intends to flow through the flow hole 114, as well as the contaminated air passing through the flow hole 114. The vortex may be formed under the swirler 340 by such a flow of air.

According to the present disclosure, when the vortex is formed under the swirler 340 by the swirler 340 and the flow guide 320, the contaminated air rising upward under the ventilation apparatus 10 may be smoothly suctioned to the ventilation apparatus 10.

Meanwhile, the cooking appliance 1 may include a front heating unit 1*b* and a rear heating unit 1*a* spaced apart from each other in front and rear directions when viewed based on FIG. 7.

In general, when the ventilation apparatus 10 is positioned above the cooking appliance 1 having the front heating unit 1*a* and the rear heating unit 1*a*, at least a portion of the rear heating unit 1*a* is disposed in overlap with the suction device 20 in the vertical direction.

Therefore, the contaminated air, which is generated when a cooking material 2 is heated using the rear heating unit 1*a*, is suctioned to the ventilation apparatus 10 flowing upward substantially vertically through the suction force of the suction device 20.

Meanwhile, as described above, as the first extension line L1 of the shaft 312 of the driving motor 310 is positioned in front of the fan housing 220 as described above, the contaminated air generated in the process of heating the cooking material 2 using the front heating unit 1*b* is inclined toward the upper left portion of the drawing while flowing, by the suction force generated by the suction device 20 and the vortex formed by the swirler 340, as illustrated in FIG. 7.

In addition, the contaminated air, which is generated in the process of heating the cooling material 2 using the front heating unit 1*b*, is prevented from being away from the wall. Accordingly, the contaminated air may be prevented from being spread into the kitchen equipped with the cooking appliance 1.

In addition, according to the present disclosure, the distance D3 from the first extension line L1 of the shaft 312 of the driving motor 310 to the rear surface 112*b* of the second casing 112 is formed to longer than the distance D2 from the first extension line L1 of the shaft 312 of the driving motor 310 to the front surface 112*a* of the second casing 112, so the minimum distance between the flow hole 114 and the wall W may be sufficiently ensured.

The air discharged from the flow hole 114 while being inclined downward may be prevented from flowing along the wall W. If the air flows downward along the wall, the air exerts an influence on the flame produced by the cooking appliance 1 to prevent the heating efficiency of the cooling appliance 1 from being lowered. Accordingly, this phenomenon may be prevented.

Although the above embodiment has been described in that the vortex forming device is provided and used in the casing of the ventilation apparatus, when the vortex forming device is implemented in the form of a module, the vortex forming device is provided under the cooking device mounted on the wall in the kitchen.

Although the above description of the embodiment of the present disclosure has been made in that all components are integrated into one part or operate as one part, the present disclosure is not limited thereto. In other words, one or more components may be selectively combined with each other to operate within the scope of the present disclosure. In addition, the terms such as "comprise", "have", or "include" refers to the presence of a relevant component unless specified otherwise, and should be interpreted as further including another component without excluding the another component. Unless otherwise defined herein, all the terms used herein, which include technical or scientific terms, may have the same meaning that is generally understood by a person skilled in the art. It will be further understood that terms used herein should be interpreted as having a meaning that is consistent with their meaning in the context of this disclosure and the relevant art and will not be interpreted in an idealized or overly formal sense unless expressly so defined in the present disclosure.

The invention claimed is:

1. A ventilation apparatus comprising:

a casing comprising a first casing and a second casing that is disposed below the first casing, a horizontal sectional area of the second casing being greater than a horizontal sectional area of the first casing;

a suction device received in the first casing, the suction device comprising a suction fan configured to generate suction force for suctioning air and a fan housing that receives the suction fan; and a vortex forming device received in the second casing, the vortex forming device comprising:

a swirler disposed at a lower portion of the second casing and configured to rotate to generate a vortex, and a driving motor configured to rotate the swirler, wherein the swirler comprises:

a rotating plate that defines an air passage hole, and a plurality of blades arranged along a rim of the rotating plate and spaced apart from one another in a circumferential direction, and wherein the vortex forming device in the second casing is positioned lower than a rotation center of the suction fan, wherein at least a portion of the suction device is located within the second housing, and wherein an uppermost point of the driving motor is positioned higher than a lowermost point of the fan housing of the suction device with respect to a bottom surface of the second casing.

2. The ventilation apparatus of claim 1, wherein the second casing includes a flow hole to introduce external air, and wherein the swirler is positioned closer to the flow hole than the suction fan.

3. The ventilation apparatus of claim 1, wherein the second casing includes a flow hole to introduce external air, wherein the suction fan is disposed to overlap with the swirler in a vertical direction, and wherein the swirler is disposed to overlap with the flow hole in the vertical direction.

4. The ventilation apparatus of claim 1, wherein the first casing extends upward from a top surface of the second casing, wherein a rear surface of the first casing and a rear surface of the second casing define one plane that faces a wall, and wherein a front surface of the second casing is positioned forward relative to a front surface of the first casing.

5. The ventilation apparatus of claim 4, wherein a rotation center of the swirler is positioned in front of a vertical line passing through the rotation center of the suction fan, based on the wall.

6. The ventilation apparatus of claim 5, wherein the rotation center of the swirler is positioned in front of the fan housing, based on the wall.

7. The ventilation apparatus of claim 1, wherein an extending line of a rotation center of the swirler is positioned outside the first casing.

8. The ventilation apparatus of claim 1, wherein a distance from a rotation center of the swirler to a front surface of the second casing is shorter than a distance from the rotation center of the swirler to a rear surface of the second casing.

9. The ventilation apparatus of claim 1, wherein a flow hole is formed in the second casing, and wherein the flow hole has a diameter greater than a left-right width of the first casing.

10. The ventilation apparatus of claim 1, wherein the vortex forming device further includes:

a flow guide to guide air, which flows in a process that the swirler rotates, downward, and wherein the driving motor is positioned under a top surface of the second casing and positioned above the flow guide.

11. The ventilation apparatus of claim 1, wherein a portion of the fan housing is received inside the second casing.

12. The ventilation apparatus of claim 11, wherein the fan housing is positioned above a flow guide, and wherein at least a portion of the driving motor overlaps with the fan housing in a horizontal direction.

13. The ventilation apparatus of claim 1, further comprising:

a mounting part that supports the driving motor and is disposed below the lowermost point of the suction device and a lowermost point of the driving motor; and a flow guide coupled to a lateral end of the mounting part.

14. The ventilation apparatus of claim 13, wherein the flow guide surrounds and covers a circumference of the swirler.

15. The ventilation apparatus of claim 14, wherein the flow guide is curved and extends downward relative to the swirler.

* * * * *